US005464346A

United States Patent [19]

Derr et al.

[11] Patent Number: 5,464,346

[45] Date of Patent: Nov. 7, 1995

[54] INFRA-RED HEATER FOR TREATING SUBSTRATES

[75] Inventors: William S. Derr, Philadelphia, Pa.; Mark D. Longacre, Merchantville, N.J.

[73] Assignee: Mersden Manufacturing Co., Pennsauken, N.J.

[21] Appl. No.: 315,340

[22] Filed: Sep. 30, 1994

[51] Int. Cl.[6] ..... F23D 14/12

[52] U.S. Cl. ..... 431/328

[58] Field of Search ..... 431/328, 329

[56] References Cited

U.S. PATENT DOCUMENTS 3,589,853 6/1971 Guasco ..... 431/328

4,255,123 3/1981 Bishilany et al. ..... 431/328

*Primary Examiner*—Carroll B. Dority

*Attorney, Agent, or Firm*—Connolly & Hutz

[57] ABSTRACT

An infra-red heater for treating substrates comprises a gas fired burner having a burner body with a plenum chamber divided by a baffle into an unbaffled upstream intake compartment and a baffled downstream intake compartment. A gas inlet communicates with the upstream intake compartment for supplying a fuel-gas mixture. A fiber matrix is located at the mouth or discharge end of the downstream intake compartment. The burner body includes peripheral side walls having downstream end portions which surround the matrix. The end portions and the matrix are outwardly tapered in the discharge direction.

4 Claims, 3 Drawing Sheets

INFRA-RED HEATER FOR TREATING SUBSTRATES

BACKGROUND OF THE INVENTION

Infra-red heaters are used in equipment for treating substrates such as in the drying of paper. A particularly effective burner is described in U.S. Pat. No. 4,722,681. As shown and described therein, the burner body has a plenum chamber divided by a baffle into an unbaffled upstream intake compartment and a baffled downstream intake compartment. A matrix is located at the downstream end of the downstream intake compartment. The matrix is disclosed as being made from ceramic fibers about one inch thick and is adhesively secured to the side walls of the burner body. The matrix is formed as a block wherein its side walls are perpendicular to its top and bottom walls. The matrix fits against the comparably shaped end portions of the side walls of the burner body.

SUMMARY OF THE INVENTION

An object of this invention is to provide an infra-red heater of the type disclosed in U.S. Pat. No. 4,722,681 wherein modifications are made thereto to improve the assembly of the components.

In accordance with this invention an infra-red heater of the type disclosed in U.S. Pat. No. 4,722,681 includes a matrix in the form of a frusto-pyramid having outwardly inclined side walls. The end portions of the burner body are also outwardly inclined to provide a greater surface area of contact for the adhesive to firmly mount the matrix in the mouth of the downstream intake compartment. The inclined sides also facilitate the assembly of the matrix to the burner body by acting as camming surfaces.

A housing may be formed around the burner body so that insulation could be mounted in the housing to aid in the effectiveness of the heater.

THE DRAWINGS

FIG. 1 is a cross-sectional view in elevation of an infra-red heater of the type shown in U.S. Pat. No. 4,722,681;

DETAILED DESCRIPTION

The present invention relates to modifications of the infra-red heater shown and described in U.S. Pat. No. 4,722,681, the details of which are incorporated herein by reference thereto. In general, the infra-red heater is utilized for treating substrates such as in the drying of paper. The combination for accomplishing those purposes will not be repeated herein in detail except as is necessary for an understanding of the present invention.

Figure 1:
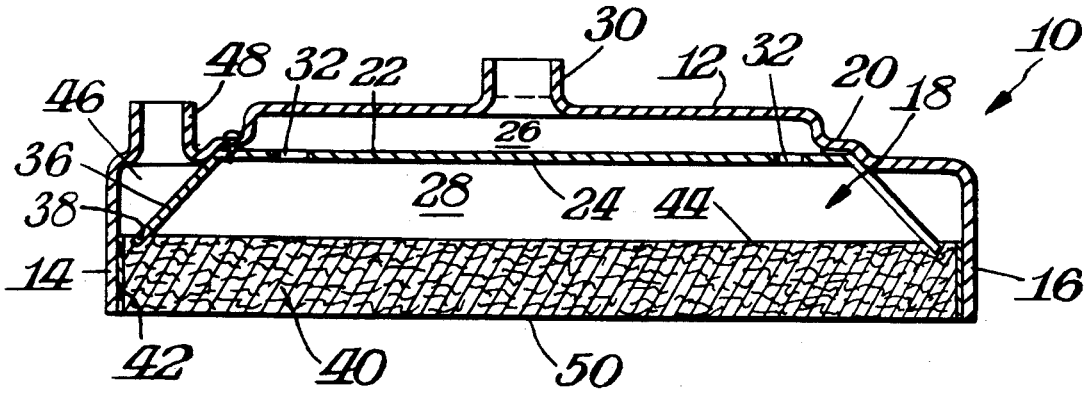
Fig. 1 (Prior Art)

FIG. 1 illustrates an infra-red heater 10 as described in U.S. Pat. No. 4,722,681. Heater 10 is a gas fired burner having a cast burner body 12 that includes side walls, two of which 14,16 integral with a back wall all define a plenum chamber 18. The back wall has a peripheral step 20 adjacent the side walls to provide a seat which receives a partition 22 that can be made of sheet metal. Partition 22 is shown as an inverted dish. The central portion 24 divides the plenum 18 into an unbaffled intake compartment 26 and a baffled intake compartment 28 for a fuel gas combustion mixture supplied through a combustion mixer input connector 30 passed into the back wall. A series of openings 32 near the margin of the central portion 24 of the partition 22 provides passage of the combustion mixture from compartment 26 to compartment 43.

The peripheral portion 36 of partition 22 is inclined to flare out from the central portion 24 so that it provides an edge 38 spaced about ½ inch from the adjacent side wall. A ceramic fiber matrix 40 which is preferably about 1 inch thick is fitted into the mouth of compartment 28 and is shown as having its margins cemented against the inner surfaces of the side walls by a thin layer of silicon adhesive 42. The internal face 44 of the matrix 40 rests against partition edges 38, so that an annular space 46 between the flared partition periphery 36 and the side walls define an air-seal plenum having an air-seal inlet connector 48. The combination is accordingly a gas-fired ceramic fiber matrix burner which would be used as part of a machine or system for treating substrates such as in the drying of paper.

In the burner 10 of U.S. Pat. No. 4,722,681 the matrix 40 is formed as a block having its side walls straight or perpendicular to the internal face 44 and the outer face 50. The end portions of the walls forming the burner body 12 are similarly shaped with straight portions to conform to the shape of the sides of matrix 40.

Figure 2:
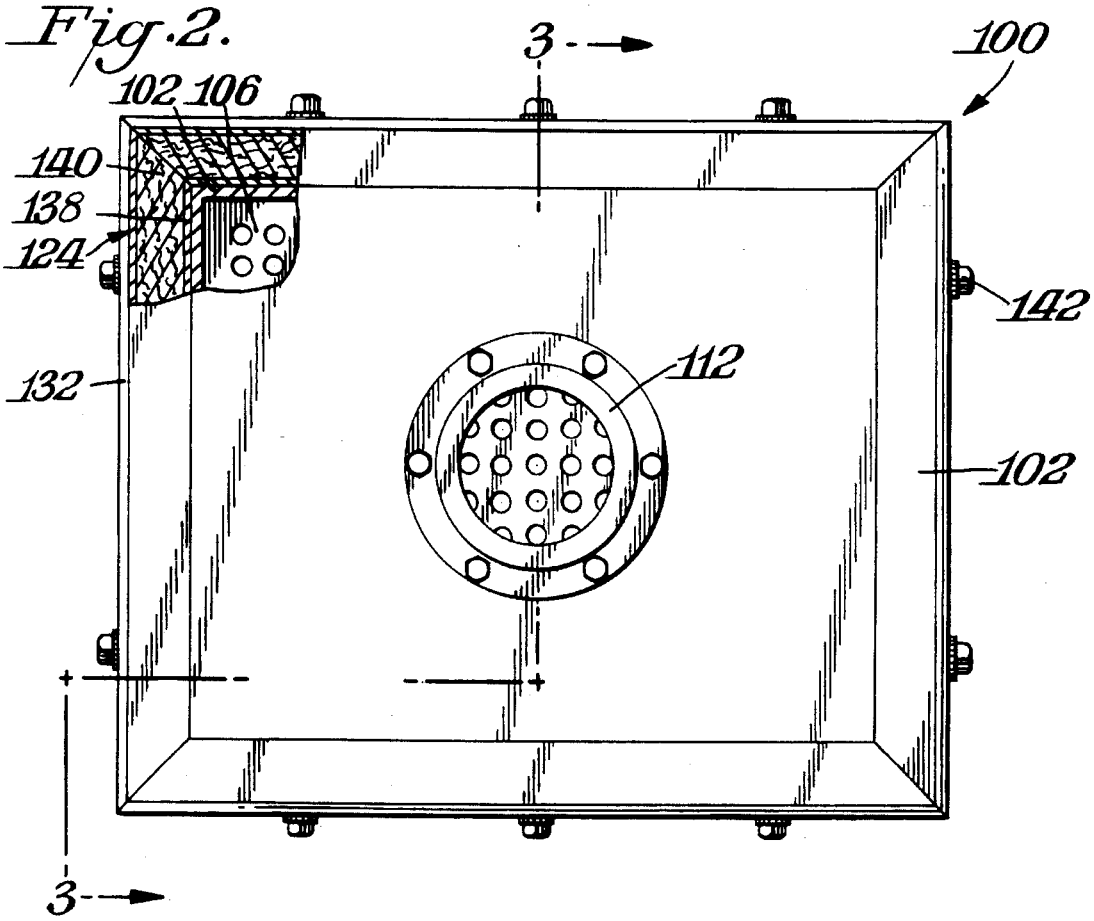
FIG. 2 is a top plan view partly broken away and in section of an infra-red heater in accordance with this invention.
Figure 3:
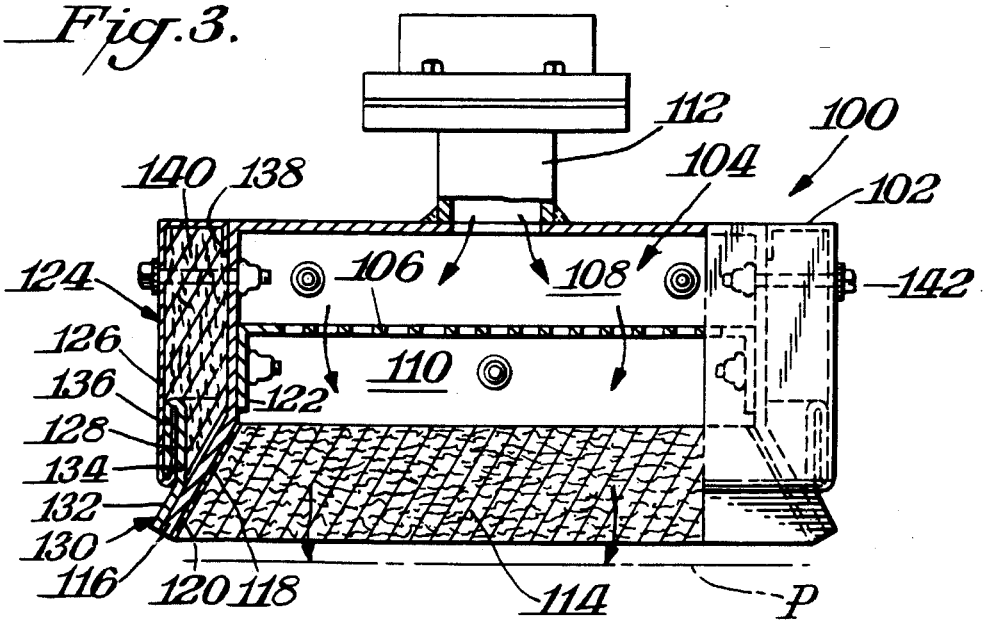
FIG. 3 is a cross-sectional view taken through FIG. 2 along the line 3—3.
Figure 4:
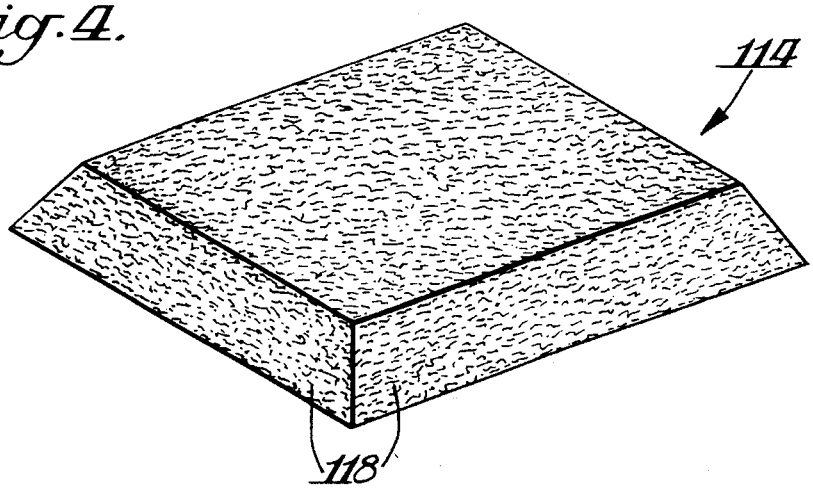
FIG. 4 is a perspective view of the matrix shown in FIGS. 2–3.

FIGS. 2–4 illustrate an infra-red heater in accordance with this invention. As shown therein the infra-red heater 100 comprises a gas-fired burner having a burner body 102 which includes a plenum chamber 104 divided by a baffle or partition 106 into an unbaffled upstream intake compartment 108 and a baffled downstream intake compartment 110. A gas inlet 112 communicates with the upstream intake compartment 108 for supplying a fuel-gas mixture to the plenum 104. A fiber matrix 114 is located in the mouth or at the discharge end of the downstream intake compartment 110.

In accordance with this invention the end portions 116 of the side walls which form burner body 102 are outwardly flared and thus correspond to the outwardly tapered sides 118 of the frusto-pyramidal shaped matrix 114. FIG. 4, for example, illustrates the matrix 114 as being in the form of a frusto-pyramid.

Because of the angled sides the assembly of matrix 114 into the burner body 102 is facilitated since the angled sides act as camming surfaces. Additionally, the angled sides provide a greater surface area for receiving the adhesive layer 120 which connects the matrix 114 to the end portions 116.

In the illustrated embodiment the matrix 114 is shown as being a four-sided frusto-pyramid. It is to be understood that the invention may be practiced with other shapes including three sides or more than four sides or circular or some other arcuate shape. The characterizing feature is outwardly inclined surfaces.

FIG. 3 illustrates the partition 106 to terminate in downwardly extending portions 122 which are perpendicular to the central portion and fit snugly against the straight portions of the burner body walls.

FIG. 3 illustrates the general operation of heater 100 wherein the flow of the fuel gas mixture is indicated by the arrows and eventually passes through matrix 114 to contact paper P.

Burner 110 advantageously includes an insulation housing 124 which surrounds the burner body. Insulation housing 124 is formed by cover plates 126 which terminate in upturned extensions 128 forming a peripheral channel in the general location of the matrix 114. The insulation housing is closed by end caps 130 which at their downstream ends fit against and are secure to end portions 116. If desired end caps 130 could be integral with end portions 116 and bent to the shape shown in FIG. 3. Caps 130 thus have inclined portions mounted against end portions 116 and have straight sections 134 connected to the inclined sections 132. The straight sections 134 terminate in downturned sections 136 mounted in the peripheral channel of the upturned extensions 138 of the walls of burner body 102 to thereby lock the caps 130 to the cover plates 126 and close the housing 124. Cover plates 126 include inner portions 138 mounted against the side walls of burner body 102. The housing is filled with a suitable insulation material 140 and is mounted to the burner body 102 by suitable fasteners 142.

The insulation 140 may thus be readily mounted around burner body 102 by having the insulation 140 inserted into the housing 124 and then mounting the housing 124 to the burner body.

The arrangement shown herein with the insulation housing 124 readily permits the installation of blanket insulation while assembling the heater.

Figure 5:
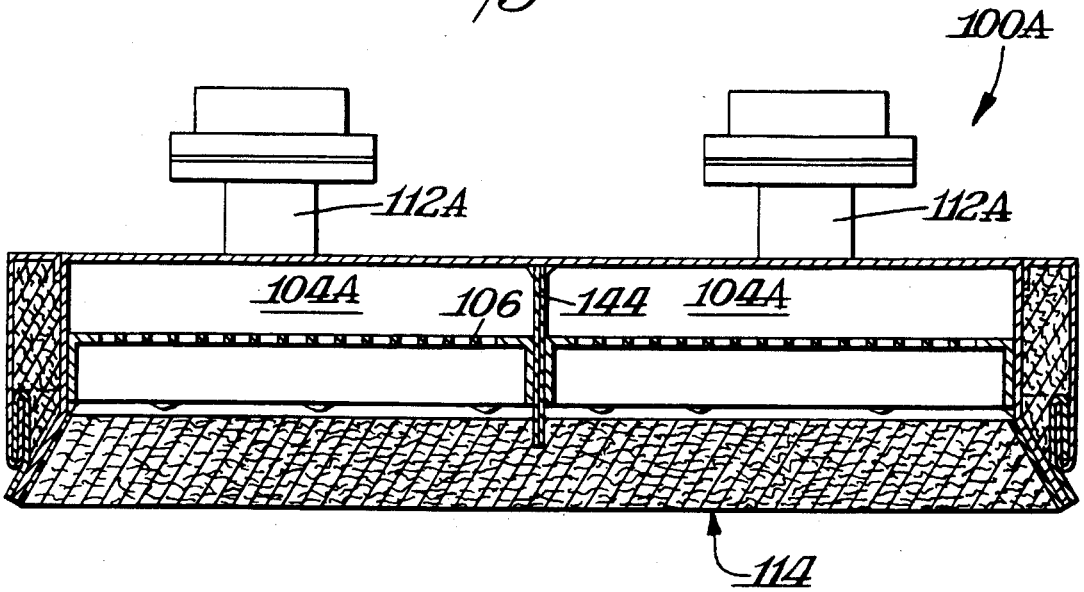
FIG. 5 is a cross-sectional view in elevation of a modified form of infra-red heater in accordance with this invention.

FIG. 5 illustrates a burner 100A which is a variation of the burner 100 in that it includes multiple inlets 112A each of which communicates with a separate plenum 104A with the plenums being separated from each other by any suitable divider means such as divider plate 144. Thus, the invention may be practiced wherein the burner body includes only a single plenum as shown in FIG. 3 or a plurality of plenums as shown in FIG. 5. In each of these variations, however, the same features would be utilized regarding the tapered or outwardly flared end walls of the matrix and the end portions of the burner body walls as well as the other details described with respect to burner 100.

Any suitable materials could be used in the practice of this invention such as the materials for the corresponding components described in U.S. Pat. No. 4,722,681. The metal material forming burner body 102 and its components is preferably aluminum to take advantage of its heat conductive characteristics. The adhesive 120 is preferably a silicon adhesive and the matrix 114 is preferably a ceramic fiber matrix.

Although the invention has been described in particular reference with the type of heater shown and described in U.S. Pat. No. 4,722,681 it should be understood that the concepts of this invention may be used in any other types of heaters for treating substrates.

What is claimed is:

1. In an infra-red heater for treating a substrate such as in the drying of paper or the like comprising a gas fired burner having a burner body with a plenum chamber divided by a baffle into an upstream intake compartment and a downstream intake compartment, a gas inlet communicating with said upstream intake compartment for supplying a fuel-gas mixture thereto, a fiber matrix in the mouth at the discharge end of said downstream intake compartment, said burner body including peripheral side walls, and said side walls including downstream end portions surrounding said matrix, the improvement being in that said end portions of said side walls and said matrix being outwardly tapered in a discharge direction, said matrix being mounted to said end portions by a layer of adhesive material therebetween, said end portions and said matrix having the shape of a four-sided frusto-pyramid, an insulation housing surrounding said burner body, blanket insulation being in said housing against sides of said burner body, said insulation housing comprising a cover plate terminating in upturned extensions forming a peripheral channel in the general location of said matrix, end caps connected to said end portions of said side walls, said end caps including inclined sections mounted against said end portions of said side wall, straight sections connected to said inclined sections, and said straight sections terminating in downturned section mounted in said peripheral channel of said upturned extension to lock said end caps to said cover plates.

2. The heater of claim 1 including a plurality of said gas inlets, divider means dividing said plenum chamber into a plurality of plenums, and each of said gas inlets communicating with a respective one of said plenums.

3. In an infra-red heater for treating a substrate such as in the drying of paper or the like comprising a gas fired burner having a burner body with a plenum chamber divided by a baffle into an upstream intake compartment and a downstream intake compartment, a gas inlet communicating with said upstream intake compartment for supplying a fuel-gas mixture thereto, a fiber matrix in the mouth at the discharge end of said downstream intake compartment, said burner body including peripheral side walls, and said side walls including downstream end portions surrounding said matrix, the improvement being in that said end portions of said side walls and said matrix being outwardly tapered in a discharge direction, an insulation housing surrounding said burner body, blanket insulation being in said housing against sides of said burner body, said insulation housing comprising a cover plate terminating in upturned extensions forming a peripheral channel in the general location of said matrix, end caps connected to said end portions of said side walls, said end caps including inclined sections mounted against said end portions of said side wall, straight sections connected to said inclined sections, and said straight sections terminating in downturned section mounted in said peripheral channel of said upturned extension to lock said end caps to said cover plates.

4. The heater of claim 3 including a plurality of said gas inlets, divider means dividing said plenum chamber into a plurality of plenums, and each of said gas inlets communicating with a respective one of said plenums.

* * * * *